United States Patent [19]

Tremont

[11] 3,932,856

[45] Jan. 13, 1976

[54] PORTABLE, GRAVITY-ACTUATED ALARM FOR USE WITH A WINDOW OR DOOR

[76] Inventor: Leo J. Tremont, 1108 SW. 25th Ave., Fort Lauderdale, Fla. 33312

[22] Filed: Dec. 9, 1974

[21] Appl. No.: 530,594

[52] U.S. Cl. ..... 340/274 R; 340/283

[51] Int. Cl.[2] ..... G08B 13/08

[58] Field of Search..... 340/283, 274 R; 200/61.93, 200/61.62, 61.72, 61.83

[56] References Cited

UNITED STATES PATENTS

| | | | |
|---|---|---|---|
| 3,029,425 | 4/1962 | Forrester | 340/274 R |
| 3,312,968 | 4/1967 | Kiefer, Jr. | 200/61.62 |
| 3,696,380 | 10/1972 | Murphy | 200/61.93 |

FOREIGN PATENTS OR APPLICATIONS

| | | | |
|---|---|---|---|
| 376 | 1/1885 | United Kingdom | 200/61.83 |

*Primary Examiner*—Glen R. Swann, III

*Attorney, Agent, or Firm*—Oltman and Flynn

[57] ABSTRACT

This portable, self-contained alarm device for a door or window is usable in one position with an inwardly-opening door or window or, in a different position, with an outwardly-opening or sliding door or window. It has a pivoted lever arranged to drop by gravity and close a magnetic switch when the door or window is opened. The alarm device may be positioned next to the door or window, or remote from it for operation by a pull cord.

13 Claims, 12 Drawing Figures

PORTABLE, GRAVITY-ACTUATED ALARM FOR USE WITH A WINDOW OR DOOR

BACKGROUND OF THE INVENTION

Various door-operated alarm devices have been proposed heretofore, for example, those shown in the following U.S. patents: U.S. Pat. No. 834,904, Mahla; U.S. Pat. No. 3,029,425, Forrester; U.S. Pat. No. 3,261,010, Kardel; U.S. Pat. No. 2,259,696, Hulst; U.S. Pat. No. 3,175,207, Hewitt; U.S. Pat. No. 3,696,380, Murphy; and U.S. Pat. No. 3,427,608, Green.

SUMMARY OF THE INVENTION

The present invention is directed to a portable alarm device that can be readily arranged to be operated by a door or a window, whether of the inwardly-opening or outwardly-opening or slidably-opening type. Because it is self-contained and readily portable, the present alarm device is particularly advantageous for use by a traveler staying in a motel or hotel, or in an apartment for a relatively short period of time that would not justify installing a permanent burglar alarm system, or in a mobile home, trailer, recreational vehicle or car. This alarm device can be positioned in immediate proximity to the door or window whose opening it is to signal, or it may be located at some distance from that door or window and operated by a pull cord extending between them.

A principal object of this invention is to provide a novel and improved portable self-contained alarm device for operation by a door or window.

Another object of this invention is to provide such an alarm device having a pivoted lever which drops down to turn on the alarm when the door or window is opened.

Another object of this invention is to provide such an alarm device which may be converted from use with an inwardly-opening door or window to use with an outwardly-opening or sliding door or window, or vice versa, simply by changing its position.

Another object of this invention is to provide such an alarm device which may be used in immediate proximity to the door or window or remote from it.

BRIEF DESCRIPTION OF THE DRAWINGS

Other objects of this invention will appear from the following description and appended claims, reference being had to the accompanying drawings forming a part of this specification wherein like reference characters designate corresponding parts in the several views.

FIG. 1 is a top perspective view of the present alarm device positioned to be actuated by a door that opens in;

DESCRIPTION OF THE PREFERRED EMBODIMENTS

Figure 1:
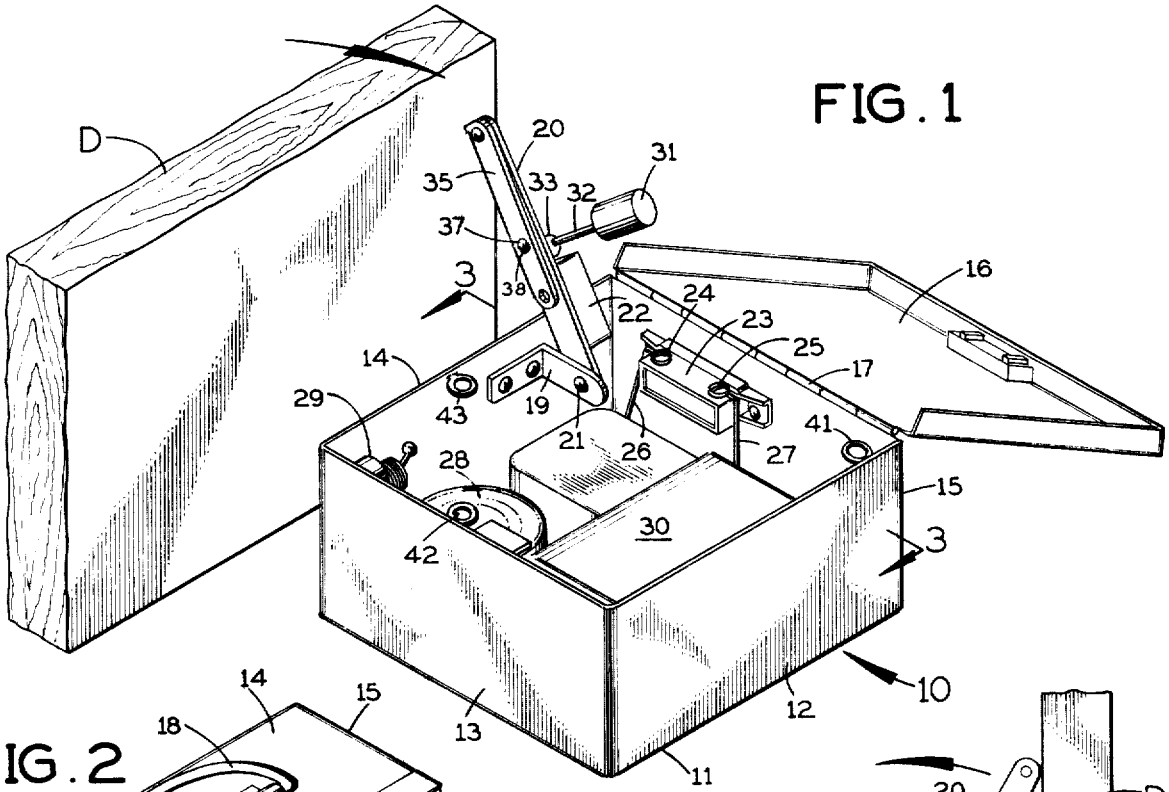
Figure 2:
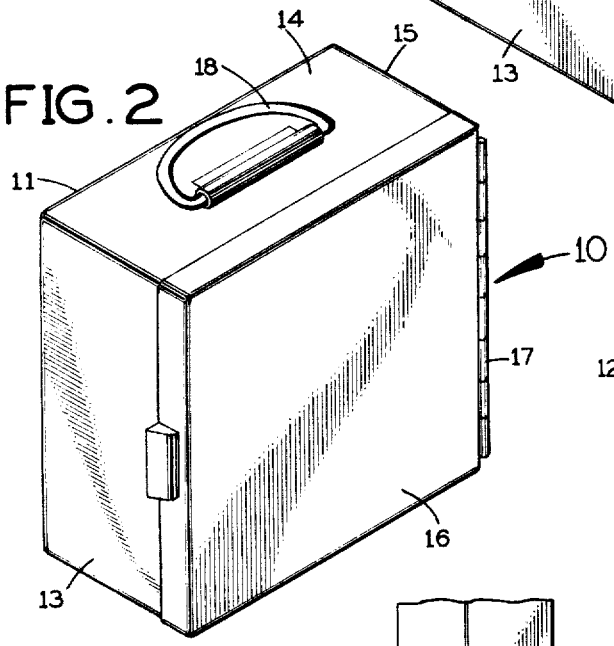
FIG. 2 is a perspective view of this alarm device folded up and presenting the appearance of a rectangular carrying case.
Figure 3:
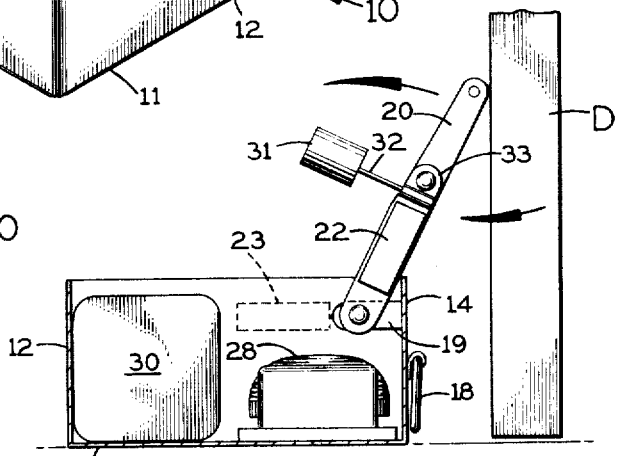
FIG. 3 is a vertical section taken along the line 3—3 in FIG. 1.

Referring first to FIGS. 1–3, the present alarm device is housed in a carrying case 10 having a flat rectangular bottom wall 11, four interconnected, upstanding, flat sides 12, 13, 14 and 15, and a lid or cover 16 which is connected by a piano hinge 17 to the upper edge of side wall 15. A pivoted handle 18 is attached to the side wall 14.

When the alarm device is to be used to detect and signal the unauthorized opening of a door that opens in, the casing is positioned as shown in FIG. 1, with its bottom wall 11 resting on the floor and the handle 18 toward the door D as shown in FIG. 3.

As shown in FIG. 1, an L-shaped bracket 19 is attached to the inside of the casing wall 14. One leg of this bracket lies flush against the inside of wall 14 a short distance below its upper edge, and the other leg of the bracket projects inwardly perpendicularly away from wall 14 and parallel to the casing wall 15. A rigid lever 20 has it lower end in FIG. 1 pivoted at 21 to the bracket 19 near the latter's inner end (away from the casing wall 14).

On the side toward the casing wall 15, the lever 20 carries a permanent magnet 22 for operating a magnetic reed switch of known design. The switch proper is in a housing 23 that is bolted to the inside of the casing wall 15, and it includes two normally spaced-apart switch contacts which are engageable with each other to close an electrical circuit. The two switch contacts are connected through terminals 24 and 25 to respective current conducting wires 26 and 27.

In the operation of this switch, normally the switch contacts are disengaged and the switch is open. However, when the permanent magnet 22 is in close proximity to the switch housing 23 it attracts the switch contacts to engage each other and close the circuit through wires 26 and 27.

Figure 4:
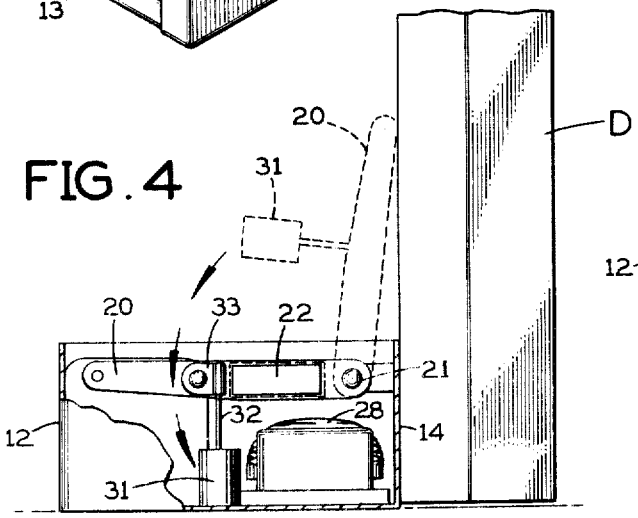
FIG. 4 is a view similar to FIG. 3, and showing in full lines the position of the parts after the alarm device has been actuated.
Figure 5:
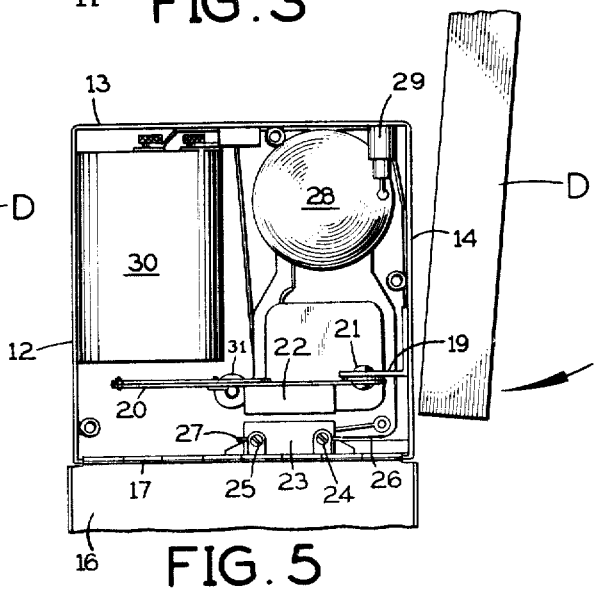
FIG. 5 is a top plan view of the actuated alarm device shown in FIG. 4.

This switch-closing action takes place when the lever 20 drops down from the upstanding position, shown in FIGS. 1 and 3, to the lowered position, shown in FIG. 4. In this latter position, the magnet 22 is spaced about one-fourth inch from the adjacent face of the switch housing, as shown in FIG. 5, and the switch is closed.

The magnetic switch is connected in series with an alarm bell 28 and a manual on-off switch 29 across a battery 30, all housed inside the casing 10.

Figure 9:
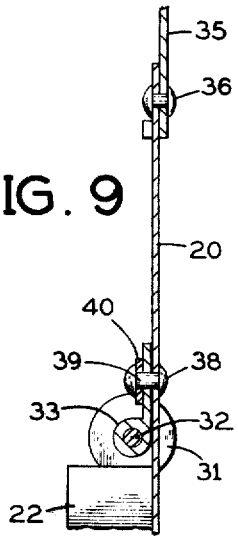
FIG. 9 is a section taken along the line 9—9 in FIG. 8.

A weight 31 is attached to the lever 20 by means of a rigid rod 32. One end of this rod is screw-threadedly engaged with the weight, and its opposite end is screw threaded into a fitting 33 on the lever 20, as best seen in FIG. 9, at a location about midway along the length of lever 20. The rod 32 extends perpendicular to the lever 20 and in a direction away from the door D when the rod is in its raised, door-engaging position, as shown in FIGS. 1 and 3.

The alarm device may be positioned next to an inwardly-opening door D as shown in FIG. 1, with the lever 20 raised to a position in which it bears against the top edge of the casing wall 14 and its outer end bears against the inside of the door. When the door is opened it forces the rod clockwise in FIG. 1 (counterclockwise in FIG. 3) until the combined center of gravity of the lever 20, rod 32 and weight 31 moves past the lever pivot 21, after which the lever drops by gravity to the switch-closing position shown in full lines in FIG. 4. The provision of the weight 31 makes it possible for this over-center movement of the center of gravity to occur after only a slight inward movement of the door has taken place, so that the alarm goes off quickly in response to an unauthorized opening of the door.

When not in use, the alarm device is de-activated by opening the on-off switch 29.

Figure 8:
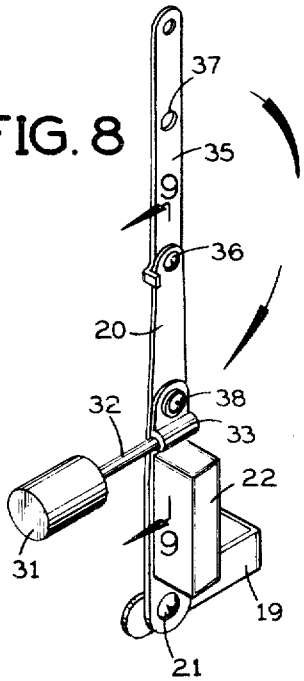
FIG. 8 is a perspective view of the pivoted lever and its extension in the present alarm device.

As best seen in FIG. 8, the lever 20 carries a normally-retracted, pivoted extension 35 for increasing the length of the lever, when desired. This extension is pivoted at 36 to the outer end of the lever 20, and normally it extends alongside the lever 20 as shown in FIG. 1. In this position, a circular opening 37 in the extension 35 snugly receives the rounded head 38 of a bolt 39 to releasably hold the extension against the lever 20. However, the user can disengage these parts by flexing the extension 35 away from the lever 20, after which the extension can be swung around the pivot 36 to the extended position shown in FIG. 8, in which it is aligned with the lever 20 and provides a straight-line extension of the lever.

Figure 6:
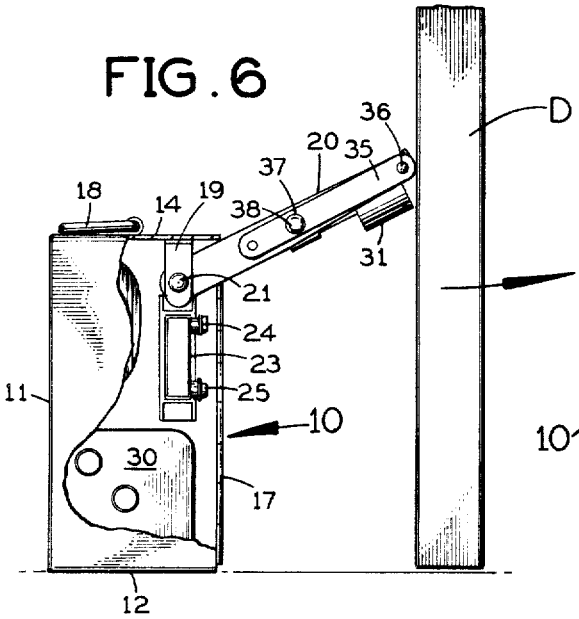
FIG. 6 is a view similar to FIG. 3 but showing the alarm device positioned to be actuated by a door that opens out.
Figure 7:
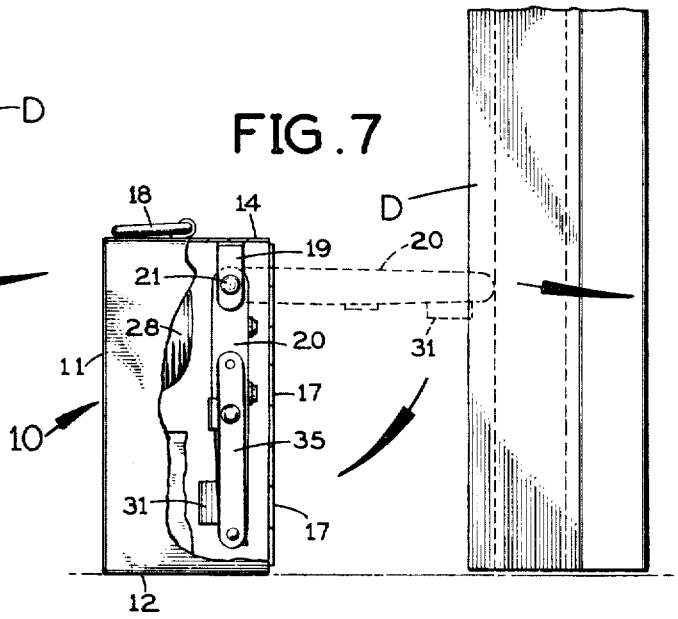
FIG. 7 shows the FIG. 6 alarm device actuated.
Figure 7:
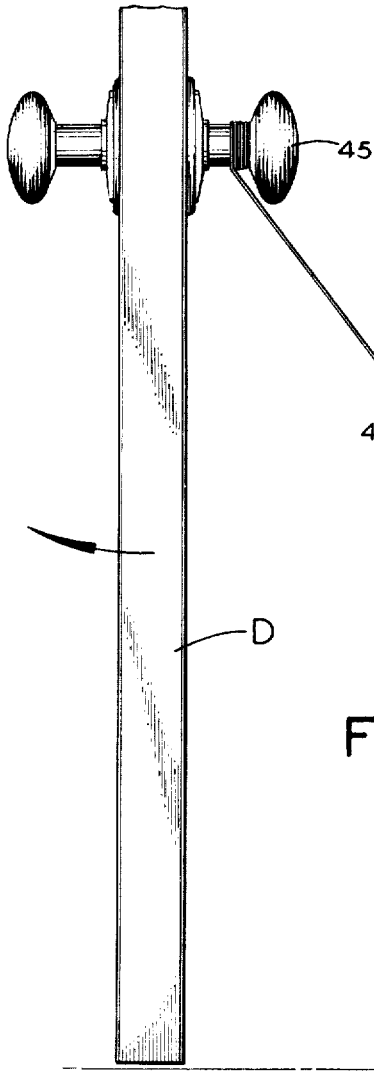

FIGS. 6 and 7 show how this same alarm device may be used with an outwardly-opening door or window or a sliding door or window. When so used, the alarm device is positioned with its side wall 12 down and with the handle 18 at the top.

The pivoted lever 20 extends out so that its outer, upper end bears against the door D.

Preferably, the weight 31 now is aligned with the lever 20. As shown in FIG. 8, the fitting 33 which connects the rod 32 to the lever 20 is pivoted at 38 to the lever. By turning this fitting one-quarter turn clockwise in FIG. 8, the rod 32 and weight 31 can be brought into alignment with the lever. A suitable clamping nut or a friction washer 40 may be provided at this pivot for holding the fitting 33 in whatever angular position it has been adjusted relative to the lever 20.

With the arrangement shown in FIG. 6, the door D is the only thing that prevents the lever 20 from dropping down by gravity to the switch-closing position.

When the support which the door provides for the outer end of the lever is withdrawn, such as by moving out away from the alarm device, as indicated by the arrow in FIG. 6, or by slding past the lever (in the case of a sliding door), then the lever and weight assembly immediately drops down by gravity to close the magnetic switch, as shown in full lines in FIG. 7.

If, instead of aligning the rod 32 and weight 31 with the lever 20, the rod 32 is kept substantially perpendicular to the lever 20, then the magnetically-operated switch may have a tendency to re-open as a result of the weight 31 rebounding from the casing wall 11 and the lever-and-weight assembly assuming a final position counterclockwise from the full line position of FIG. 7 with the magnet 22 offset from the switch casing 23. In that case, the alarm circuit may include a relay that closes in response to a momentary closing of the magnetic switch and then remains closed even if the magnetic switch re-opens.

As shown in FIG. 1, the casing of the alarm device has several metal "eyes" attached to the inside for slidably receiving a flexible pull cord. In the particular embodiment illustrated, a first eye 41 is attached to the inside of the casing wall 12 near its top edge and close to its juncture with the casing wall 15, a second eye 42 is attached to the inside of the casing wall 13 near its top edge at a location closer to the wall 14 than to wall 12, and a third eye 43 is attached to the inside of the casing wall 14 near its top edge at a location closer to wall 13 than to wall 15.

Figure 10:
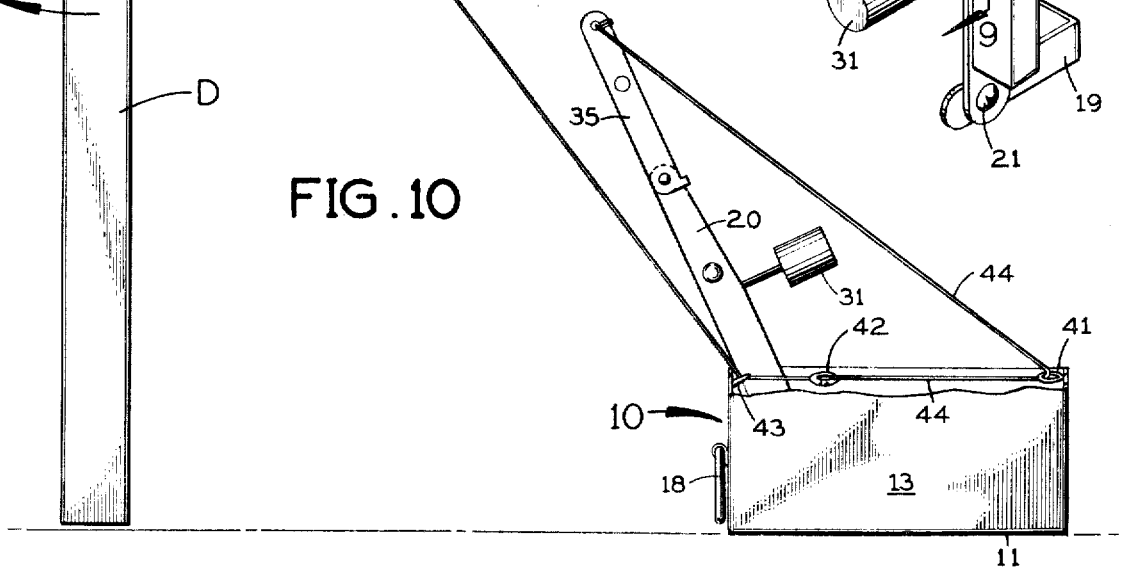
FIG. 10 shows the present alarm device connected by a long flexible cord to a remotely located door whose opening will actuate the alarm device.

A flexible cord 44 may be slidably passed through these eyes, as shown in FIG. 10, with one end of the cord attached to the outer end of the lever and the other end attached to the door knob 45 of a remotely located door that opens out.

With this pull cord arrangement, the alarm device can be positioned at any desired location in the premises to be protected and not in immediate proximity to the door or window, as already described in detail with reference to FIGS. 1–5 and FIGS. 6 and 7.

In the use of this alarm device, the lever extension 35 may be fully retracted, as shown in FIGS. 1–7, or fully extended, as shown in FIGS. 8–10, or it may be set at any intermediate angular position with respect to the lever 20. For this purpose, any suitable releasable clamping arrangement may be provided, such as a bolt and nut assembly at the pivot 36.

Figure 11:
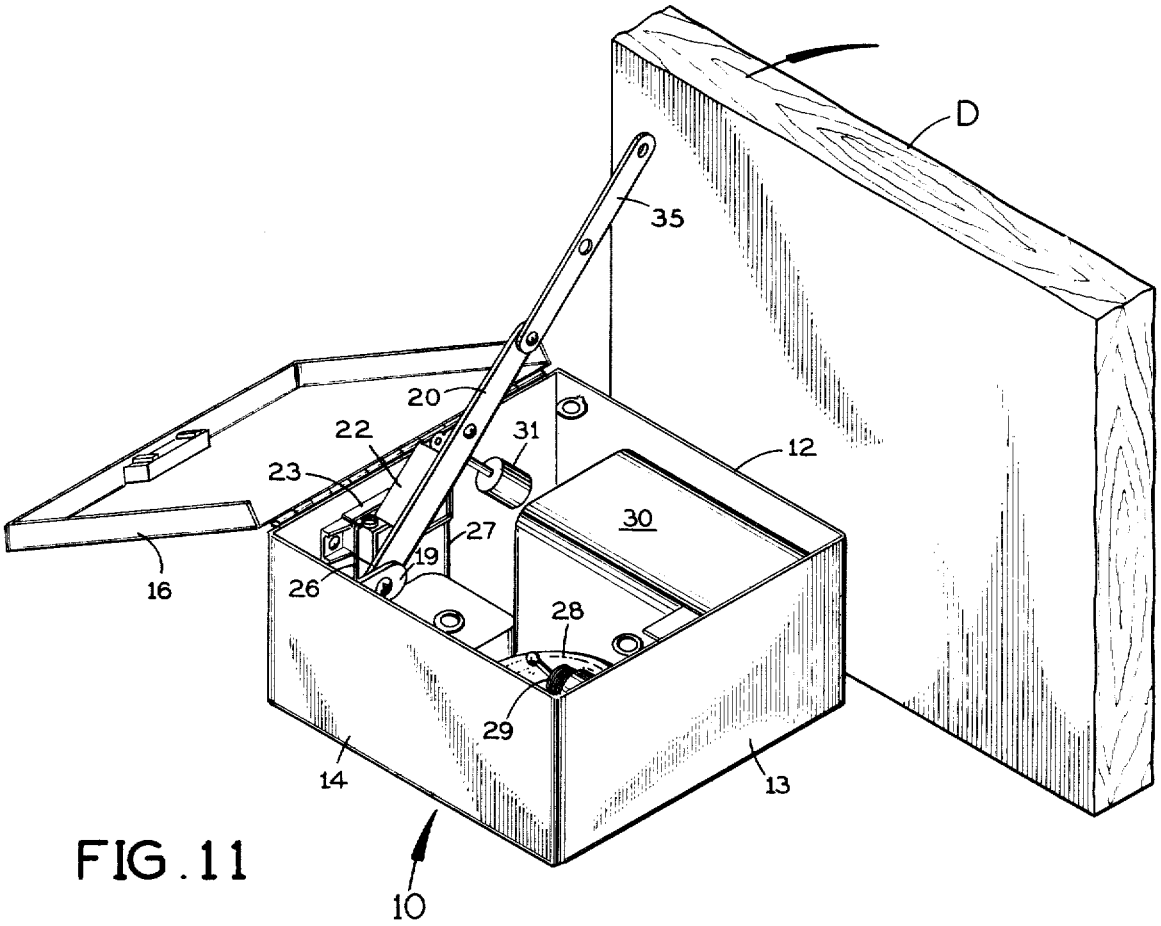
FIG. 11 is a perspective view of the alarm device positioned another way at an outwardly or slidably opening door.
Figure 12:
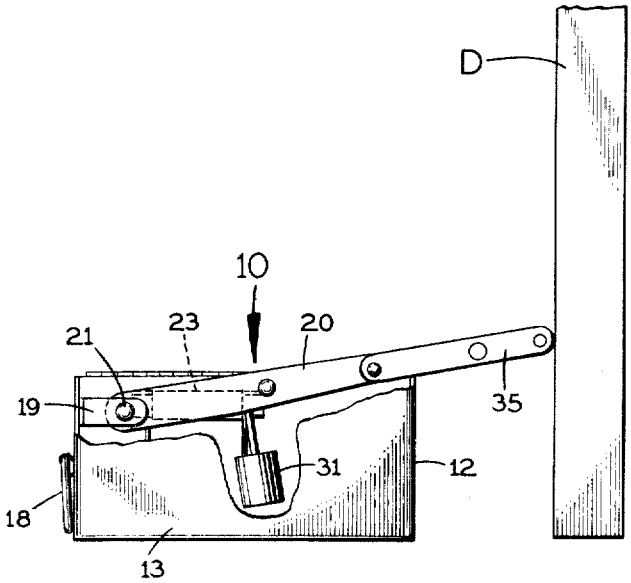
FIG. 12 is a vertical elevation, partly broken away for clarity, showing the alarm device in FIG. 11 actuated by the opening of the door.

FIGS. 11 and 12 show a different way of using the present alarm device with an outwardly opening or slidably opening door. The casing wall 11 of the alarm devices rests on the floor or other horizontal support, and the casing wall 12 is toward the door D. The lever 20 and its extension 35 extend up from the lever pivot 21 at an acute angle to the horizontal, passing above the top edge of the casing wall 12 for engagement of the outer end of the extension 35 against the inside of the door. Instead of being aligned with the lever 20, the extension 35 may be set at any convenient angle extending upward from the outer end of lever 20.

The door provides the only restraint against the downward movement (by gravity) of the pivoted lever 20 and its extension 35. When this restraint is removed by opening the door, the lever 20 and its extension 35 drop down as shown in FIG. 12 to a position in which the magnet 22 on the lever is close enough to the switch casing 23 to operate the switch inside.

I claim:

1. In an intrusion alarm device for a door or window comprising:

a lever for engagement with a door or window when the latter is closed, means pivotally mounting said lever to drop down by gravity when the door or window is opened;

a magnetic switch having a permanent magnet on said lever and magnetically-operated switch means mounted in spaced relationship to said mounting means for the lever for operation by said magnet when the lever drops down;

and signalling means operable to signal an alarm when said switch means is operated;

the improvement wherein said switch means is positioned to one side of the path of movement of said lever when the latter drops down and is in close proximity to said magnet when the lever is down.

2. In an intrusion alarm device for a door or window comprising:

a lever for engagement with a door or window when the latter is closed, means pivotally mounting said lever to drop down by gravity when the door or window is opened, a weight attached to said lever to pull the lever down when the door or window is opened;

a magnetic switch having a permanent magnet on said lever and magnetically-operated switch means mounted in spaced relationship to said mounting means for the lever for operation by said magnet when the lever drops down;

and signalling means operable to signal an alarm when said switch means is operated;

the improvement wherein said weight is offset from said lever in a direction to pull the lever down by gravity when the door or window is opened.

3. An alarm device according to claim 2, and further comprising a rod attached at one end to said lever away from the latter's pivotal mounting, said weight being attached to the opposite end of said rod.

4. An alarm device according to claim 3, wherein said rod is threadedly engaged on at least one end for adjustment of its effective length between said lever and said weight.

5. An intrusion alarm device for a door or window comprising:

a lever for engagement with a door or window when the latter is closed, means pivotally mounting said lever to drop down by gravity when the door or window is opened;

a magnetic switch having a permanent magnet on said lever and magnetically-operated switch means mounted in spaced relationship to said mounting means for the lever for operation by said magnet when the lever drops down;

and signalling means operable to signal an alarm when said switch means is operated;

the improvement which comprises a casing having peripheral sides, and wherein:

said means pivotally mounting the lever comprises a bracket inside the casing;

said lever in its raised position extends up past the edge of one side of the casing and outside the casing for engagement of its outer free end with the door or window;

and said lever when it drops down moves into the casing.

6. An alarm device according to claim 5, wherein said switch means is positioned inside the casing to one side of the path of travel of said lever when the latter drops down into the casing and is closely spaced from said magnet when the lever is down.

7. An alarm device according to claim 6, and further comprising a weight attached to the lever between its pivot and its outer free end, and means for offsetting said weight from the lever for pulling the lever by gravity down into the casing when the door or window is opened.

8. An intrusion alarm device comprising:

a casing having a bottom wall, upstanding interconnected side walls, and a hinged cover;

a generally L-shaped bracket inside said casing having a leg which extends substantially parallel to a side wall of the casing;

magnetically-operated switch means attached to said side wall and projecting therefrom into the casing;

a lever pivoted at one end to said bracket leg and extending therefrom substantially parallel to said one side wall of the casing and beyond an adjoining side wall for engagement at its opposite end with a door or window;

a permanent magnet attached to said lever on the side toward said one side wall of the casing, said magnet moving with said lever into close proximity to said switch means for closing said switch means magnetically when the lever drops down pivotally from engagement with the door or window;

and signalling means in said casing connected electrically to said switch means for signalling an alarm when said switch means closes.

9. An alarm device according to claim 8 wherein said signalling means comprises a battery and a battery-operated sounding device inside said casing, and a manually-operated on-off switch in said casing connected in series with said magnetically-operated switch means and said sounding device across said battery.

10. An alarm device according to claim 8, and further comprising a weight attached to the lever between its pivot and said opposite end, and means for offsetting said weight from the lever for pulling the lever by gravity down into the casing when the door or window is opened.

11. An alarm device according to claim 10, wherein said last-mentioned means comprises a rod attached at one end to said lever between the latter's ends, said weight being attached to the opposite end of said lever.

12. An alarm device according to claim 10, wherein said lever has an extension pivoted to said opposite end, and means for releasably holding said extension retracted alongside the lever.

13. An alarm device according to claim 8, and further comprising cord-guiding members attached to the inside of certain of said side walls of the casing for slidably passing a pull cord for the lever.

* * * * *